United States Patent [19]

Simonotti et al.

[11] 4,361,086

[45] Nov. 30, 1982

[54] SERIAL PRINTER FOR OBJECTS MOVABLE IN A PREDETERMINED DIRECTION

[75] Inventors: Lucio Simonotti, Banchette d'Ivrea; Carlo Motta, Borgofranco d'Ivrea, both of Italy

[73] Assignee: Ing. C. Olivetti & C., S.p.A., Ivrea, Italy

[21] Appl. No.: 253,915

[22] Filed: Apr. 14, 1981

[30] Foreign Application Priority Data

Apr. 16, 1980 [IT] Italy ..... 67587 A/80

[51] Int. Cl.[3] ..... B41J 1/22

[52] U.S. Cl. ..... 101/93.18; 271/2; 400/158; 101/93.42

[58] Field of Search ..... 101/93.18, 93.41, 93.42, 101/93.28-93.36; 400/153, 158, 158.1, 159; 271/2, 254, 273-274; 269/310

[56] References Cited

U.S. PATENT DOCUMENTS

| | | | |
|---|---|---|---|
| 2,753,793 | 7/1956 | Daly et al. | 101/93.36 |
| 2,941,653 | 6/1960 | Kriemelmeyer, Jr. | 271/2 X |
| 3,720,954 | 3/1973 | Czyryk | 400/158 |
| 3,902,411 | 9/1975 | Gardner et al. | 271/2 X |
| 3,954,054 | 5/1976 | Busch | 400/153 X |
| 3,967,550 | 7/1976 | Busch | 101/93.41 X |
| 4,019,617 | 4/1977 | Englund et al. | 400/158.1 X |
| 4,067,566 | 1/1978 | Williams | 271/2 |
| 4,170,350 | 10/1979 | Conti | 271/274 |

FOREIGN PATENT DOCUMENTS

| | | | |
|---|---|---|---|
| 1101834 | 9/1956 | Fed. Rep. of Germany | 101/93 R |
| 2112791 | 10/1972 | Fed. Rep. of Germany | 400/153 |

*Primary Examiner*—E. M. Eickholt

*Attorney, Agent, or Firm*—Edward F. McKie, Jr.

[57] ABSTRACT

The printer is included in an apparatus for depositing valuables in envelopes, which are conveyed to a depositor at a constant speed. The printer includes a type wheel inked by a removable inking roller and selectively rotatable by a stepping motor, each time from the angular position of the previous printed character.

A guiding roller normally holds the envelope distanced from the type wheel and is removed at a constant rate for causing the envelope to be printed.

In the interval between two subsequent character printing operations the envelope is advanced one letter space, whereas the type wheel has time to be rotated at least one revolution.

9 Claims, 4 Drawing Figures

SERIAL PRINTER FOR OBJECTS MOVABLE IN A PREDETERMINED DIRECTION

BACKGROUND OF THE INVENTION

This invention relates to a serial printer for printing on objects movable in a predetermined direction, having a type carrier selectively conditionable selecting the type to be printed and conveying means for so moving said object at a constant speed.

There are several apparatuses where sheet of papers or envelopes are moved by a conveyor past a printing head and must be printed or stamped with some information. There are known devices, i.e. the postal franking apparatuses, where said information is completely prearranged and the stamping is effected in a single operation. These devices are unable to print messages formed of a set of alfanumeric characters which are highly changed from time to time, i.e. the identification number of a costumer depositing valuables in an envelope into a self-service depositing apparatus of a bank.

The main object of the invention is to provide a very simple serial printing device capable of printing in a line of a moving object a message during the movement of the object.

SUMMARY OF THE INVENTION

According to the invention we now provide a serial printer of the above type, wherein the improvement comprises urging means urging yieldably said object toward said typecarrier, guiding means cooperating with said urging means for normally guiding said object to move spaced apart from said type carrier, and print command means operable at a constant rate for removing said guiding means to cause said object to be pressed by said urging means against said type carrier.

BRIEF DESCRIPTION OF THE DRAWINGS

The invention will be described in more detail, by way of example, with reference to the accompanying drawing, in which.

DESCRIPTION OF THE PREFERRED EMBODIMENT

Figure 1:
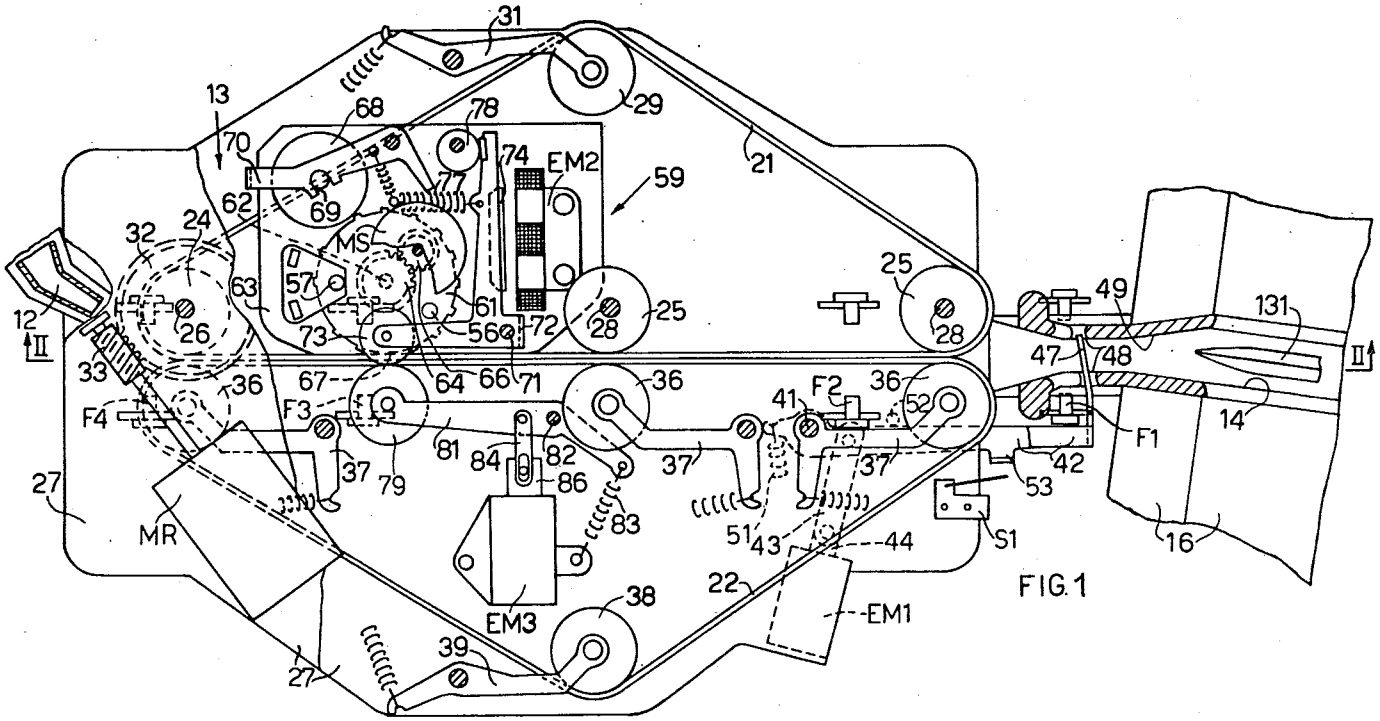
FIG. 1 is a partial horizontal section of the apparatus for depositing valuables incorporating a serial printer according to the invention.

With reference to FIG. 1 there is generally indicated a duct 12 for feeding empty envelopes coming from a magazine located within the apparatus to a conveyor, generally indicated 13, which can convey the envelopes towards a vertical slit 14 on the front panel 16 of the apparatus. This further includes a storage drawer not shown in the drawings, which is provided with a hopper adjacent the conveyor 13, under the duct 12. The apparatus is incorporated in a bank note dispenser operated by means of credit cards, which includes a central control unit for the various devices, indicated 20 in FIG. 3, a keyboard 10 for entering data and commands, and a display 9 for instructions to the client. The keyboard 10 and the display 9 are disposed on the panel 16 (FIG. 1) and are normally protected by a vandal proof roller shutter which opens automatically upon insertion of a credit card as described in the U.S. Patent application filed on Jan. 22, 1981 Serica, entitled "Apparatus for depositing and/or withdrawing bank-notes by means of credit cards."

In particular, the conveyor 13 includes two pairs of belts 21 and 22 cooperating along a common path which constitutes the path of the envelope. This path lies substantially between the slit 14 and the duct 12.

Figure 2:
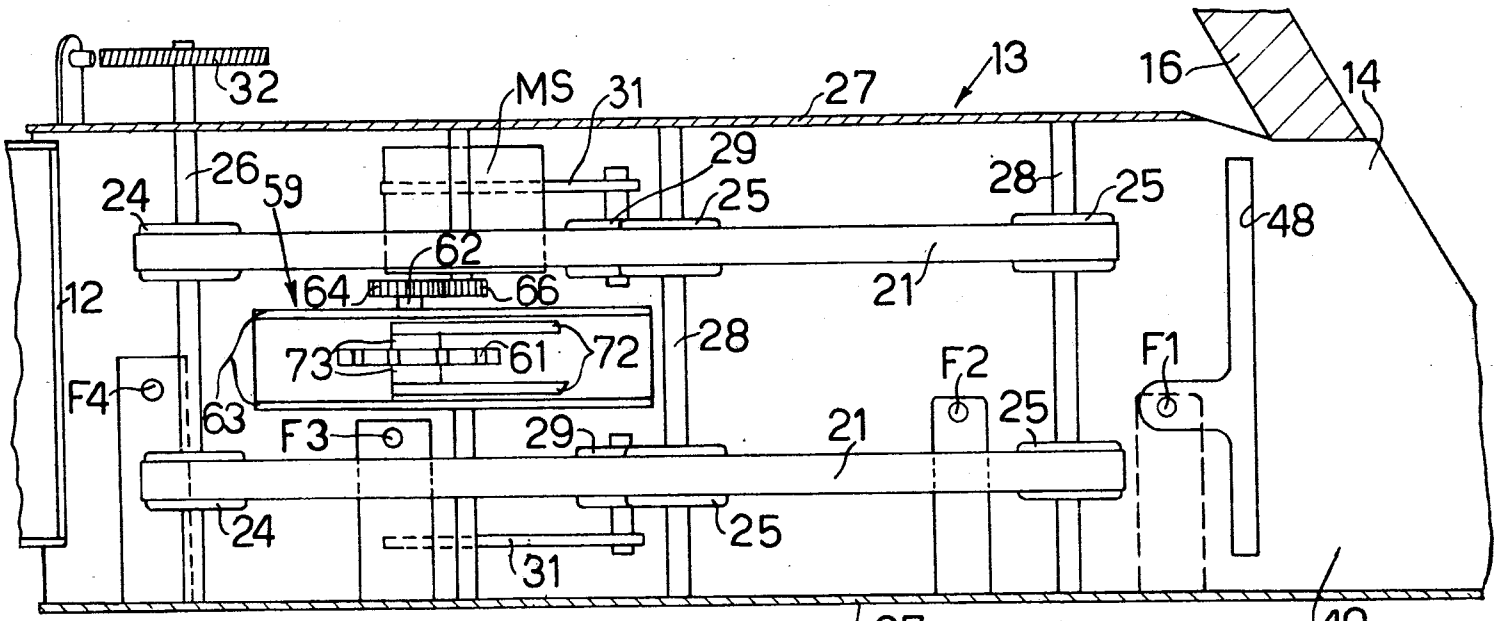
FIG. 2 is a section taken on the line II—II of FIG. 1.

The two belts 21 are driving belts, and pass over two corresponding sets of pulleys 24 and 25 (FIGS. 1 and 2). The pulleys 24 are fixed on a shaft 26 rotatable on the framework 27 of the apparatus. The pulleys 25 are, on the other hand, freely rotatable on corresponding shafts 28 fixed on the framework 27. For each belt 21 there is, moreover, provided a belt-tensioner pulley 29 (FIG. 1) carried by a resiliently biased lever 31. On the shaft 26 there is fixed a worm wheel 32 in engagement with a worm screw 33 which is driven to rotate by a reversible electric motor MR.

The belts 22 are driven belts and pass over two corresponding series of pulleys 36 each of which is carried by a resiliently biased lever 37 in such a way as to urge the belts 22 towards the belts 21 adapting itself to the thickness of the envelope in transit. For each belt 22 there is moreover provided a belt-tensioner pulley 38 carried by a resiliently biased lever 39.

On a fixed axis 41, on which the resiliently biased levers 37 of the pulleys 36 adjacent the slit 14 are pivoted, there is also pivoted a bridge 42 connected by means of a link 43 to a core 44 of a pull-in solenoid EM1. The bridge 42 is provided with a crosspiece 47 which is normally engaged in an opening 48 in a duct 49 extending between the slit 14 of the panel 16 and the two pairs of pulleys 25,36. A spring 51 normally holds the lever 42 in contact with a fixed stop 52 in such a way that the duct 49 is closed by the crosspiece 47. The bridge 42 is further provided with a tab 53 which can engage a switch S1 for indicating the occurrence of operation of the solenoid EM1.

Along the path of the envelopes there are provided four photoelectric cells F1,F2,F3 and F4 which identify a corresponding number of positions of the envelope. In correspondence with the photoelectric cell F3, between the two pairs of belts 21 and 22 (FIG. 2) there is located an envelope printer or stamping device, generally indicated 59. This device includes a character wheel 61 which carries 16 characters comprising the ten numbers 0–9 and several symbols. The wheel 61 is fixed on a shaft 62 which is rotatable on the fixed frame 63 of the printer 59. The wheel 61 carries a synchronisation element 56, (FIG. 1) i.e. a magnetised insert, which can cooperate with a sensor 57 to synchronise the rotation of the wheel 61 with the central unit 20. On the shaft 62 there is also fixed a toothed wheel 64 in engagement with a pinion 66 fixed on the shaft of a stepping motor MS which can selectively rotate the wheel 61 clockwise to carry the characters to be printed from time to time into correspondence with the printing position 67. An inking wheel 68 cooperates with the wheel 61, the inking wheel being engaged in a recess 69 in the arms of a bridge 70 which is resiliently urged in an anti-clockwise sense, holding the wheel 68 in contact with the wheel 61. It is possible to remove and replace the wheel 68 by acting manually on the bridge 70.

On a fixed pin 71 there is pivoted a bridge 72 carrying two rollers 73 in correspondence with the printing point 67. On the bridge 72 there is further fixed a core 74 of an electromagnet EM2. The bridge 72 is normally held by a large spring 77 in contact against a fixed but adjustable stop constituted by an eccentric 78. In this position the rollers 73 hold an envelope passing the wheel 61 spaced from this thereby avoiding any printing. With the rollers 73 there cooperates a pressure roller 79 carried by a lever 81 pivoted on a fixed pin 82 and urged in a clockwise sense by a spring 83 over which the spring 77 prevails. A link 84 pivoted on the lever 81 is connected by a pin and slot coupling to the core 86 of another solenoid EM3.

For the control of the operations of the apparatus described there is provided a microprocessor 186 (FIG. 3) for example an 8 bit microprocessor of the type commercially available under the name "INTEL 8035", which is connected by a serial interface 187 to the control unit 20. It is also connected, through a multiple channel 188 and an input/output interface 189, to an encoder unit 191 for the signals received from the sensor 57, the switch S1 and the photocells F1–F4, to allow the unit 191 to transmit them to the microprocessor 186. The unit 189 is also connected to a driver unit 192 for the electromagnets EM1–EM3 and the motors MS–MR. Because this latter is of the reversible type, in FIG. 6 there has been indicated an envelope outputting control circuit MRU, which controls rotation in the sense such as to dispense an envelope, and a deposition control circuit MRD which controls rotation in the opposite sense.

Figure 4:
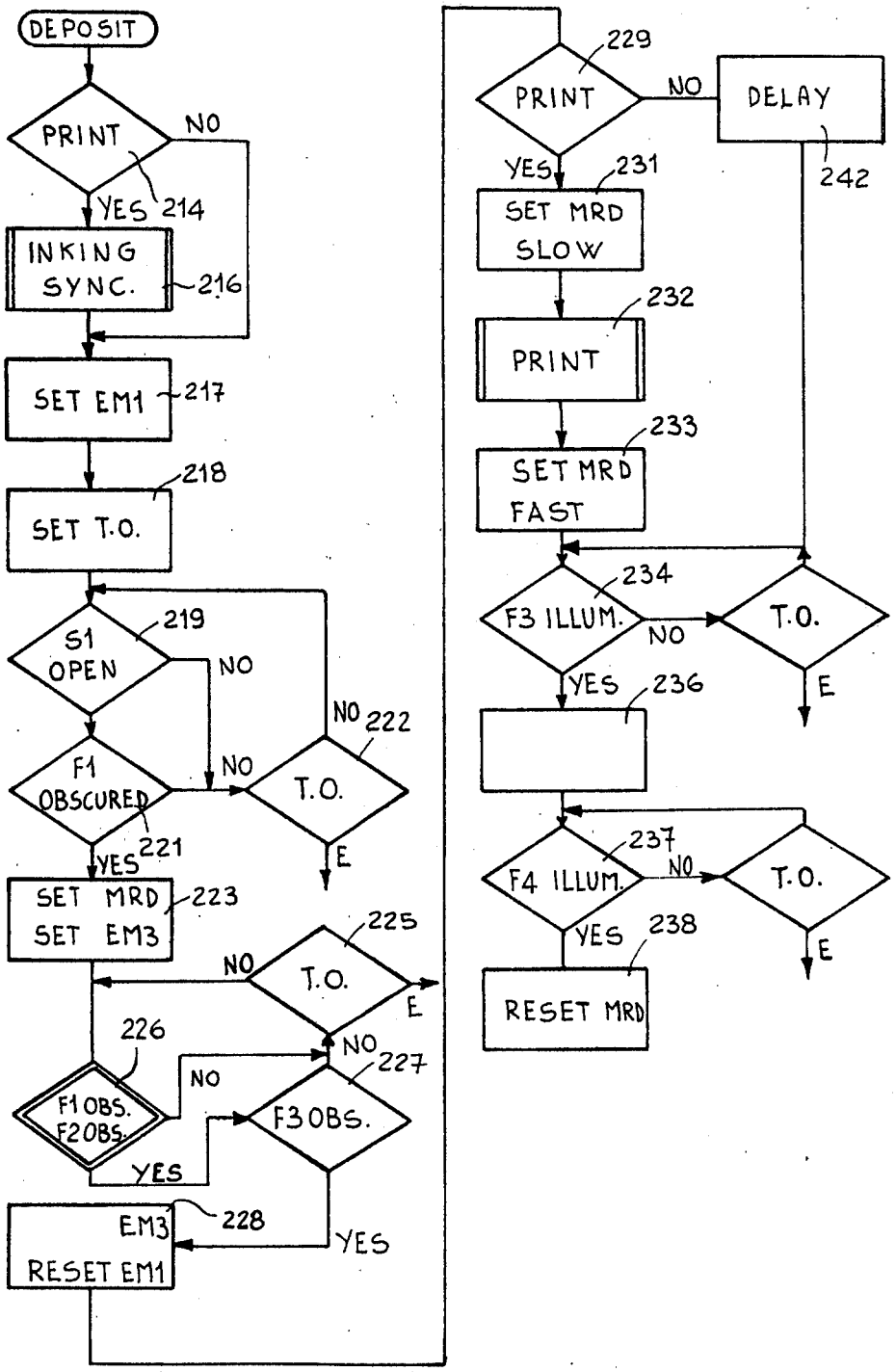
FIG. 4 is a flow diagram illustrating the operation of the apparatus.

The operation of the apparatus will now be described with the aid of the flow diagram of FIG. 4.

Figure 3:
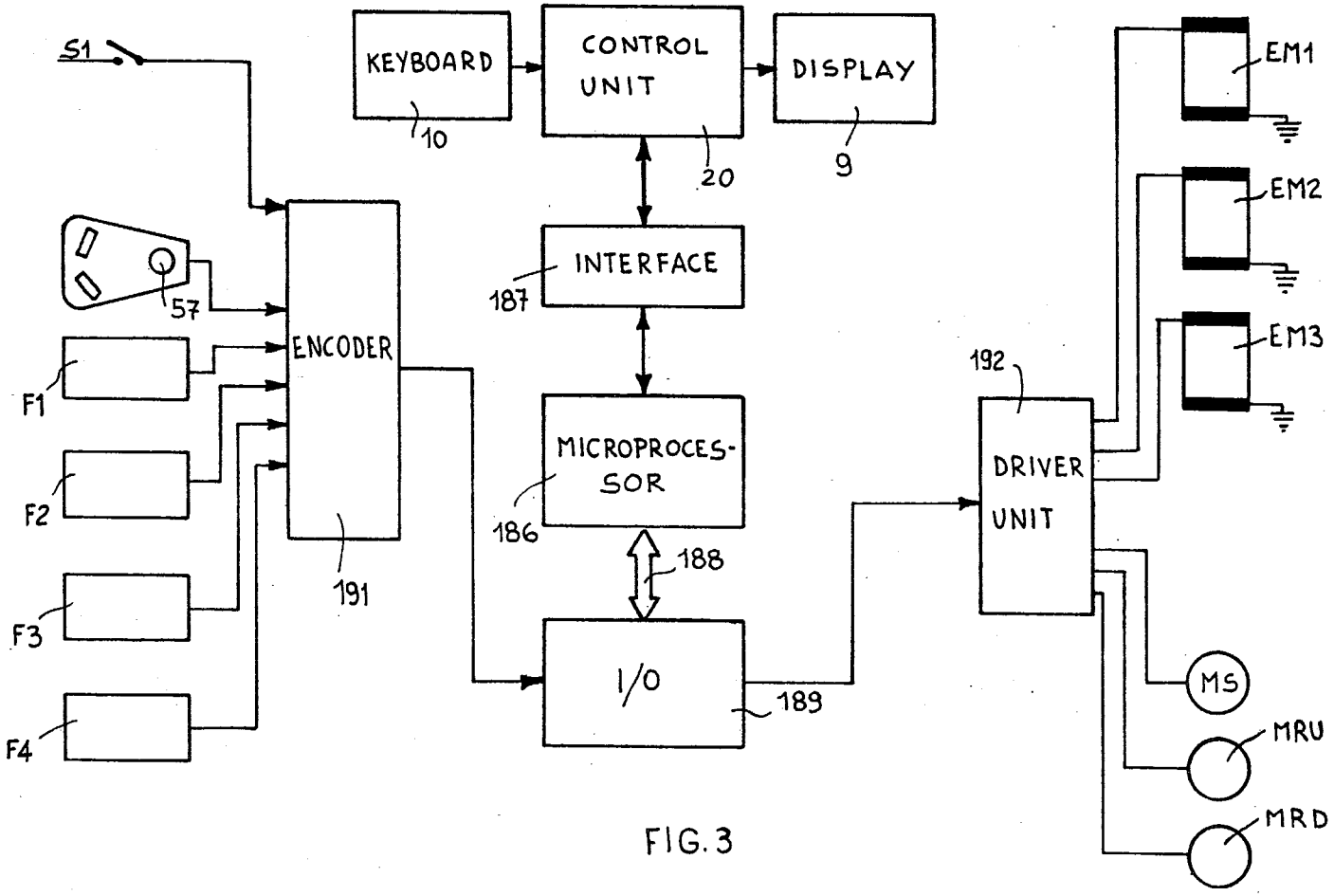
FIG. 3 is a block schematic diagram of the electronic control of the apparatus.

Initially, the operator inserts his credit card into the apparatus and the validity of this is checked by the control unit 20 (FIG. 3). Then the operator enters on the keyboard 10 the operation to be performed, which for this apparatus can be a request for an envelope or to deposit an envelope. In fact the operator can make a deposit in his own envelope, the dimensions of which can vary within certain limits, or else can effect deposition in an envelope requested from the apparatus.

It is supposed that the operator has requested and obtained an envelope and that he now wishes to deposit a full envelope 131.

Now the operator enters on the keyboard 10 (FIG. 3) a deposit command. He must also declare if he requires deposit with printing of the envelope or else deposit without printing. The entire command message is sent to the control unit 20 which now passes to the microprocessor 186 a message which recalls the deposit programme from the ROM, whilst it sets a switch which indicates whether printing has been requested or not. First of all the microprocessor 186 performs a polling 214 (FIG. 4) of this switch. If printing has been requested a routine 216 is performed which controls inking and synchronisation of the character wheel 61 (FIG. 1). For this purpose the motor MS is put into rotation in such a way as to make the wheel 61 perform at least one revolution so that the characters are inked by the roller 68. If the element 56, which indicates the rest position of the wheel 61, passes the sensor 57 twice consecutively this indicates that the wheel 51 has performed at least one revolution and causes the motor MS to stop at the said rest position.

Subsequently, the microprocessor 186 (FIG. 3) controls energization of the electromagnet EM1 (operation 217 in FIG. 4), so that the lever 42 (FIG. 1) is turned and opens the duct 49 to allow the insertion of a full envelope 131 into the slit 14. When such opening has occurred the switch S1 is closed. After this the microprocessor 186 (FIG. 3) sets a suitable time out within the envelope must be introduced (operation 218 in FIG. 4) after which there follows a poll 219 to establish if the switch S1 has been closed and a poll 221 to establish if the envelope has obscured the photocell F1. If the result of one or the other of the two polls is negative there is performed a further time out poll 222 which causes the polls 219 and 221 to be repeated so that they do not generate an error signal E to shut down the apparatus as seen before. If, on the other hand, the two polls 219 and 221 give positive results an operation 223 is performed, by means of which the microprocessor 186 (FIG. 3), via the driven unit 196, causes energization of the circuit MRD in such a way as to make the motor MR (FIG. 1) rotate at high speed in a direction such as to convey the envelope 131 rapidly into the conveyor 13. Further, the microprocessor 186 (FIG. 3) causes energization of the electromagnet EM3 (operation 223 in FIG. 4) which spaces the roller 79 (FIG. 1) from the rollers 73. Now a series of polls, indicated 226 in FIG. 4, are performed to establish if the envelope 131 (FIG. 1) passes correctly across the photocells F1 and F2 and to establish if the length of the envelope 131 is within the limits. If the result of the polls 226 (FIG. 4) is positive there is performed another poll 227 for establishing if the photocell F3 is obscured. A negative result of polls 226 and 227 after the associated time out (poll 225) indicates an error.

If, on the other hand, the result of the poll 227 is positive, an operation 228 is performed which, on the one hand causes de-energization of the electromagnet EM3 (FIG. 1) so that the roller 79 presses the envelope 131 against the rollers 73, and on the other hand de-energises the electromagnet EM1 so that the duct 49 (FIG. 1) is reclosed. Meanwhile the microprocessor 186 (FIG. 3) effects sampling 229 (FIG. 4) of the switch indicative of the printing requests. If the result of this sampling is positive, an operation 231 is performed by means of which the unit 192 (FIG. 3) causes energization of the circuit MRD in such a way as to make the motor MR (FIG. 1) rotate at slow speed. This speed is proportional to the speed of the stepping motor MS and is such as to allow advance of the envelope 131 by one character pitch in the time that the motor MS takes to perform a complete revolution of the character wheel 61. A printing routine, indicated 232 in FIG. 4, has now begun, by means of which there is printed in series on the envelope 131 a message transmitted from the central unit 20 (FIG. 3) to the microprocessor 186. In particular, for each character the motor MS (FIG. 1) turns by a corresponding number of steps with respect to the preceding position, thus selectively positioning the wheel 61 with the desired character on the printing point 67. After a predetermined time, equal to one rotation of the wheel 61, the microprocessor 186 causes excitation of the electromagnet EM2 which causes the bridge 72 to turn, temporarily separating the rollers 73 from the envelope. This is now carried into contact with the wheel 61 so as to effect printing by the pressure exerted by the spring 83. Shortly afterwards the electromagnet EM2 is de-energised and the motor MS again caused to rotate to select the next character. Obviously, to pass from one character to the next, the wheel 61 generally performs a rotation less than 360°. However, when the same character is to be printed repeatedly, the wheel 61 still performs a complete revolution each time so that its inking by means of the roller 68 is ensured.

At the end of the printing routine 232 (FIG. 4) the circuit MRD is again energised to rotate the motor MR at high speed (operation 233) so that the envelope 131 is rapidly advanced towards the hopper. A poll 234 (FIG. 4) is now performed to establish if the envelope 131 has cleared the photocell F3. When this is illuminated the microprocessor 186 control an operation 236 to drive the envelope 131 into the drawer 17. A poll 237 is now performed to establish if the envelope has cleared the photocell F4. If this is affirmative the microprocessor 186 performs an operation 238 which causes de-energization of the circuit MRD so that the motor MR (FIG. 1), and therefore also the conveyor 13 is stopped. In absence of other deposits, the control unit 20 after a predetermined time causes the vandal-proof roller shutter to close, and the apparatus is returned to its rest state.

When the operator commands a deposit without printing, the poll 214 gives a negative result and the operation 217 is immediately performed. The negative result of the poll 229 is instead followed by a delay operation 242 after which the poll 234 of the photodiode F3 follows so that the envelope 131 is rapidly conveyed onto the duct as in the preceding case.

It is understood that the apparatus described can be modified and improved without departing from the scope of the invention. For example, the programme of the microprocessor can provide a series of instructions to indicate to the operator the cause of any stoppage, indicated in the diagram of FIG. 4 by the signal E.

We claim:

1. A serial printer for printing on objects movable in a predetermined direction, having a type carrier selectively conditionable for selecting the type to be printed and conveying means for so moving said object at a constant speed, wherein the improvement comprises urging means urging yieldably said object toward said type carrier, guiding means cooperating with said urging means for normally guiding said object to move spaced apart from said type carrier, and print command means operable at a constant rate for removing said guiding means to cause said object to be pressed by said urging means against said type carrier.

2. A printer according to claim 1, wherein said object is a variably filled envelope, which is conveyed by a pair of couples of belts, each couple of belts having a portion mutually cooperating along a predetermined planar path, said type carrier, said urging means and said guiding means being located between said pair of belt couples in correspondence with said planar path.

3. A printer according to claim 2, wherein said urging means and said guiding means are formed of a pair of rollers spring urged one toward the other, a pair of electromagnets for individually removing the action of the relevant spring urge, said command means controlling said electromagnets as to cause said envelope to contact said type carrier at a predetermined instant.

4. A printer according to claim 2, wherein said belts are operated to move said envelope at such speed that in the time interval between two subsequent operations of said command means at such a rate said envelope is moved one letter space.

5. A printer according to claim 4, wherein said type carrier is formed of a type wheel selectively rotated in a constant direction by a stepping motor each time from the angular position of the previous printed character, the speed of said motor being such as to cause at least one revolution of said type wheel in said time interval.

6. A printer according to claim 5, wherein said stepping motor is controlled by a central control unit bearing a message to be printed, envelope sensing means being provided to cause said control unit to synchronize the printing operation with the movement of the envelope.

7. A printer according to claim 6, including at least one element on said wheel for indicating a predetermined angular position thereof, and a sensor connected to said control unit and adapted to sense the passage of said element.

8. A printer according to claim 7, comprising an inking roller continuously contacting said wheel, said control unit controlling said stepping motor before supplying the data of said message as to rotate until said sensor senses twice said element.

9. A printer according to claim 8, wherein said roller is connected by one way connection with a support member, spring urged to hold said roller in contact with said wheel, said support member including a portion manually operable for allowing removal and insertion of said roller.

* * * * *